United States Patent [19]

Rowan

[11] Patent Number: 4,545,687

[45] Date of Patent: Oct. 8, 1985

[54] CLOCK CONSTRUCTION

[75] Inventor: Paul D. Rowan, Toronto, Canada

[73] Assignee: Umbra Shades Ltd., Scarborough, Canada

[21] Appl. No.: 579,252

[22] Filed: Feb. 13, 1984

[51] Int. Cl.[4] ..... G04B 19/06

[52] U.S. Cl. ..... 368/232; 368/309

[58] Field of Search ..... 368/228, 232, 236, 276, 368/285, 286, 309; 206/301

[56] References Cited

U.S. PATENT DOCUMENTS 3,889,806 6/1975 Casella ..... 368/285 X

FOREIGN PATENT DOCUMENTS 2247910 6/1973 Fed. Rep. of Germany ..... 368/232
348115 9/1960 Switzerland ..... 368/232
2062907 5/1981 United Kingdom ..... 368/232

*Primary Examiner*—Vit W. Miska
*Attorney, Agent, or Firm*—Kenneth M. Garrett

[57] ABSTRACT

A clock has a face comprising a rigid base layer, an overlaying layer of resilient padding and an enveloping film layer. The clock movement may be conveniently supported from the face, the sounding board effect of the base layer being diminished by the foam layer. The base may formed of hardboard or the like, the film layer providing both a decorative and protective function therefor.

12 Claims, 5 Drawing Figures

CLOCK CONSTRUCTION

FIELD OF INVENTION

This invention relates to articles having a decorative structure, and to a method therefor. It is particularly described in relation to clocks and faces therefor, but it is not necessarily restricted thereto.

BACKGROUND OF INVENTION

Traditionally, a clock comprises a clock movement, and a housing for the movement, from which housing is supported a clock face. In other clocks, the face may itself form a structural element from which the movement is supported. These structural face clocks are advantageous in comparison to traditional clocks in permittng a relatively facile change in the appearance of the clock, as the housing is no longer a stricture. There is concomitant advantage in reducing the manufacturing cost of the clock. Certain disadvantages may be attendant, however. Typically, a kitchen wall clock may have a face with a diameter of some 25 to 35 cms (10 to 14 inches). Where the clock face is not held firmly by a housing structure, it may be subject to warpage when formed from a material such as hardboard, which is susceptible to variations in the ambient humidity. The structural clock face also tends to act as a sounding board to amplify the sound of the clock movement, which may be found objectionable by some individuals. Moreover, in traditional clock structures, the housing normally supports a transparent cover for the face, whereas in a structural face clock such cover is more usually absent. The cover functions in part to reduce the clock noise, and in further part to reduce the exposure of the clock face to changes in ambient humidity, and together therewith, to often heavily contaminated air which deposits grease or other particulate matter on the clock. Where no cover is provided the grease will deposit directly upon the clock face, hence the surface finish thereof should be relatively durable to permit frequent cleaning.

OBJECTS OF THE INVENTION

It is a primary object of this invention to provide clocks of a structural face type wherein the face may be relatively free from warpage even though constructed from a material such as hardboard.

It is a further object of my invention to provide clocks of a structural face type wherein the sounding board effect may be reduced.

It is yet another object of my invention to provide clocks of a structural face type wherein the face is of a durable nature.

It is yet another object of my invention to provide clocks of a structural face type which have a novel appearance, and which appearance may be readily changed as part of the manufacturing process.

SUMMARY OF THE INVENTION

In accordance with one aspect of my invention, a clock includes a structural face comprising a rigid base member, an overlaying resilient padding layer on a one major surface thereof which forms the obverse face of the clock, and an enveloping layer of a thermoplastic film. Preferably the thermoplastic film serves to at least partially compress the padding layer, which, as a corollary, maintains the thermoplastic film in contact therewith in tension, whereby the film assumes a relatively smooth and wrinkle free skin thereover. The enveloping layer serves to seal and protect the contents of the envelope. Thus, where the base material is a hardboard, it retains its structural stability without warping, even though the clock face may be exposed to saturated or supersaturated atmospheres during normal use. The layer of padding assists in draping the thermoplastic film covering the obverse face over the peripheral edge of the blank, so as to provide an enhanced illusion of depth to the clock face when seen from the obverse face.

Preferably, the resilient padding layer is a layer of thermoplastic foam material, for example a polyurethane foam. The thickness of the padding layer is not critical. Obviously the sound absorbing effect of the padding will vary with the thickness of the layer and the nature of the padding, however, and generally speaking, a resilient polyurethane foam padding layer having a thickness of some 2 to 3 mms will provide a noticable reduction in the sound radiated by the clock face, where this is a light hardboard material, and it will also provide a pleasing, rounded edge appearance to the clock face and give it a greater depth so as to appear to be of more substantial construction.

In accordance with method aspects of the invention, a blank is provided comprising a rigid base member and an overlaying padding layer on a one side thereof which will form the obverse face of the clock. The blank is then located on a first portion of self-supporting thermoplastic film material, and overlayed with a second portion of thermoplastic film material, and the resulting sandwich compressed in a sealing die to form a continuous seal between the opposed layers about the peripheral margin of the blank and generally in the plane of the reverse face thereof.

Expediently, the first portion of film material is in the form of a continuous web, which serves to transport the blanks into and from the sealing die.

In accordance with a preferred embodiment of the invention, the blank is struck from a laminate of a hardboard and a thermoplastic foam layer, thereby ensuring the register of the rigid base and the overlaying padding.

While the layer of thermoplastic film covering the obverse face may be drawn or otherwise shaped to provide a downturned margin to conform to the peripheral edge of the blank prior to the sealing step, this is not generally found to be either necessary or desirable. In accordance with a preferred feature of the invention, the portion of the film intended to cover the obverse face is planar, and the sealing die draws the film downwardly about the peripheral edge of the blank. Since a relatively light gauge hardboard material only is required to form the structural base, the cutting dies therefor are relatively inexpensive, as are the sealing dies, hence the perimetric shape of the clock face can be changed frequently without particular regard to amortization costs of expensive molds such as may be required where a decorative clock housing is employed.

My invention will be further described in relation to a preferred embodiment thereof, as illustrated in the accompanying drawings.

DESCRIPTION OF THE PREFERRED EMBODIMENT

Figure 2:
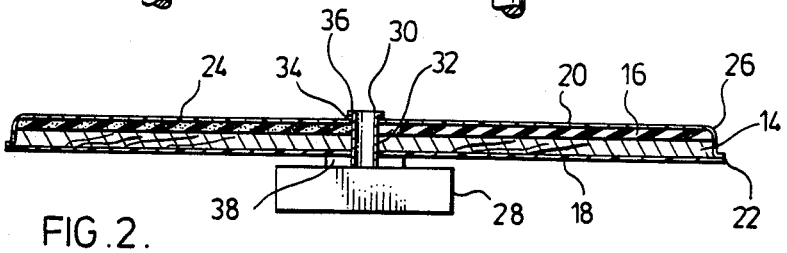
FIG. 2 shows the face of the clock of FIG. 1 in diametric cross section.

Referring to the drawings in detail, a clock which is identified therein generally by the number 10, comprises a structural face 12. As best seen in FIG. 2, face 12 comprises a layer of rigid base material 14, which is here a hardboard layer having a thickness of some 3 mm. Base material 14 is overlayed by a layer of resilient polyurethane foam material 16. The base 14 and overlaying layer of foam material 16 are enveloped by a back layer of a thermoplastic film material 18, and a front layer of thermoplastic material 20 which is sealed to back layer 18 around the periphery of face 12 at 22. Back layer 18 and front layer 20 may be dissimilar films, but will of course be compatible for sealing purposes. The front layer 20 is under tension, caused by a compression of the resilient foam material 16, which causes the front layer to assume a smooth planar condition over the major, central area 24 thereof. The peripheral margin 26 of face 12 is smoothly rounded in cross section, giving an enhanced and pleasing appearance of depth to the clock face.

Clock 10 further comprises an enclosed movement 28, with a screwed boss 30 projecting forwardly therefrom through which pass the hour, minute and second hand shafts of the movement. A clock face 12 has a central opening 32 therethrough which passes screwed boss 30. It is not found necessary to seal the front layer 20 and back layer 18 of the enclosing film materials within central opening 32. A sealing function is provided on the forward side of the clock face by a washer 34 and nut 36 which engage screwed boss 30, and on the other side of the clock face by a rubber washer 38 which is sandwiched between the movement enclosure 28 and the clock face as nut 36 is tightened on boss 30. Rubber washer 38 also provides a good frictional surface which resists relative rotational movement between the clock movement 28 and the face 12 so as to maintain them in register, and still further it tends to reduce the transmission of noise from the clock movement to the clock face.

Figure 1:
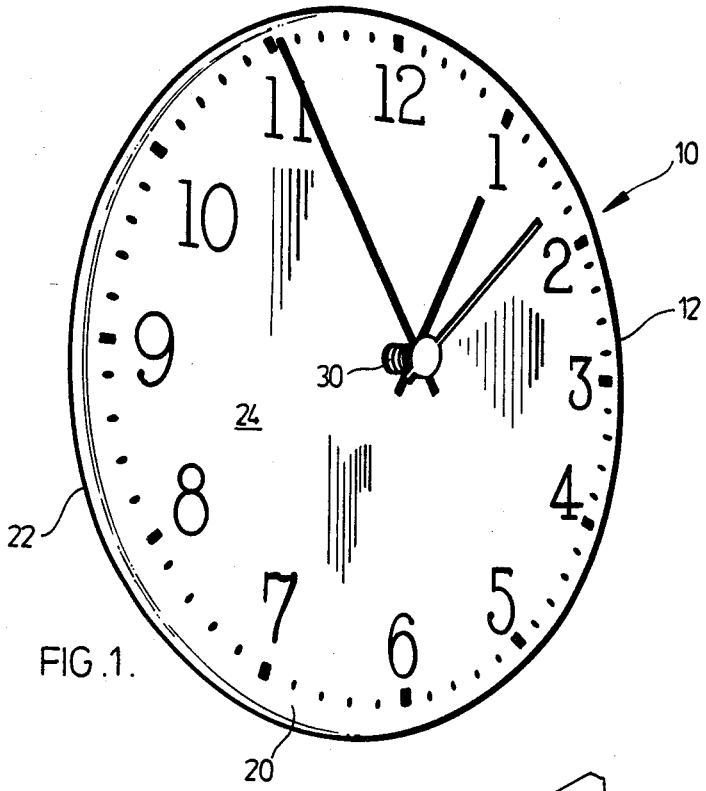
FIG. 1 shows a clock constructed according to my invention.
Figure 3:
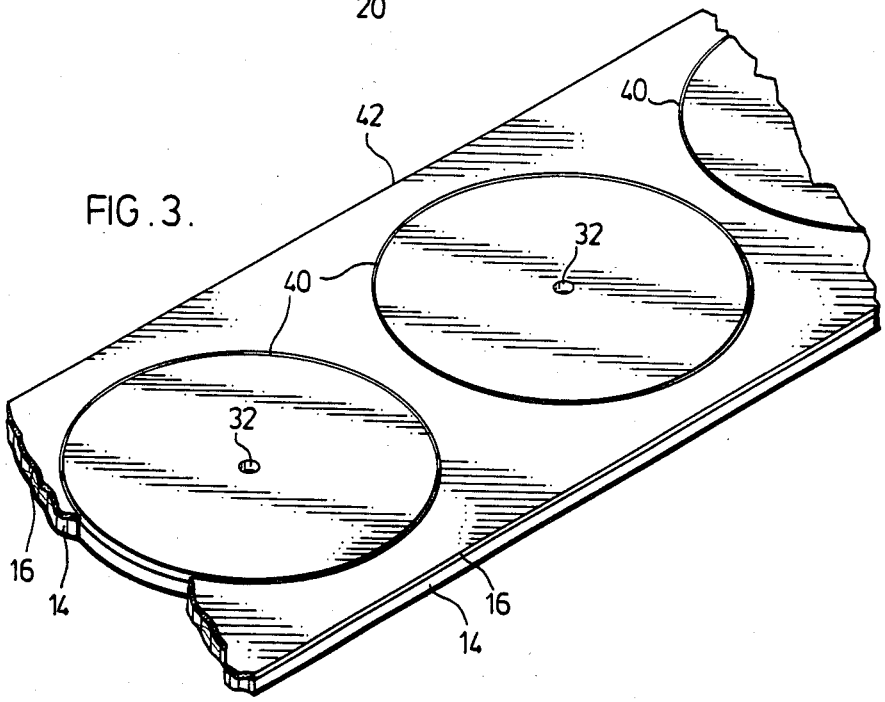
FIG. 3 shows a broken away portion of a web of base material overlayed with a layer of foam material with blank faces struck therein.
Figure 4:
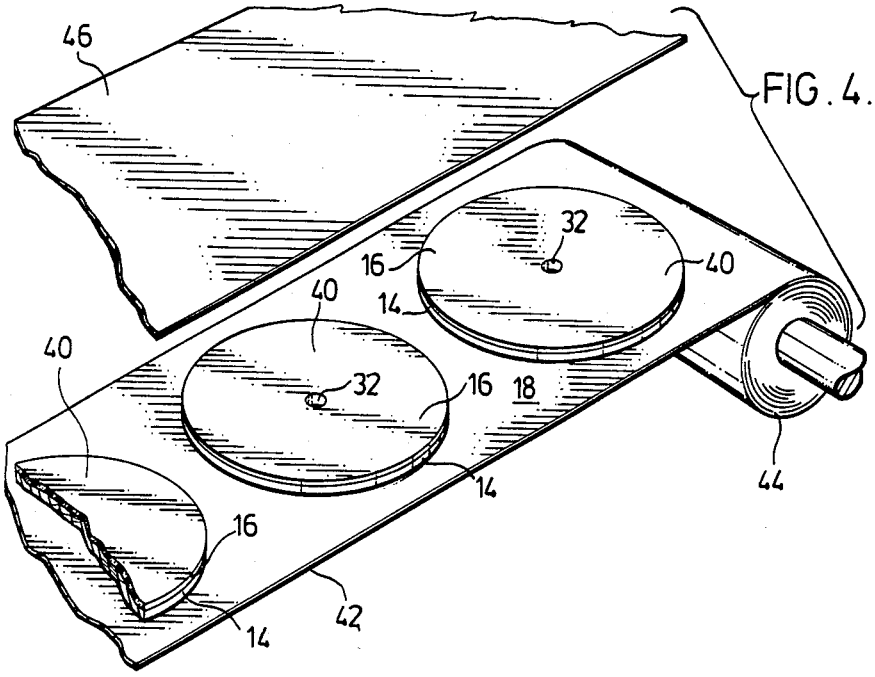
FIG. 4 shows a sandwich comprising the blanks of FIG. 3 positioned on a supporting web of plastic film material, with a second layer of plastic film material superposed for sealing to the first film material.
Figure 5:
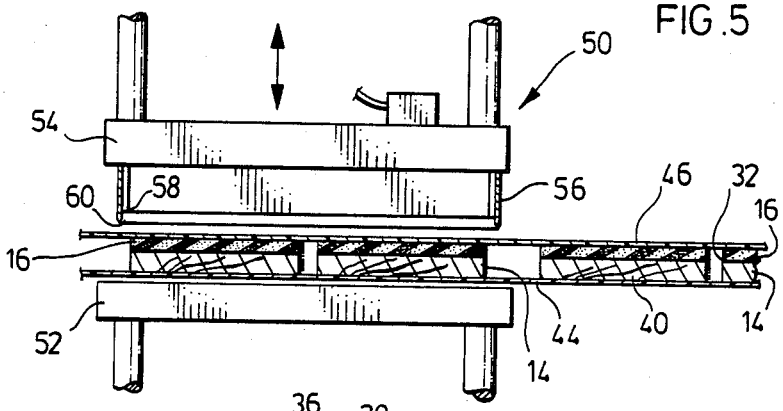
FIG. 5 shows in schematic elevation a sealing station with the sandwich of FIG. 4 positioned between sealing dies.

Referring now to FIGS. 3–5, a clock face 12 is manufactured by striking blanks 40 having the desired peripheral shape from a laminated sheet 42 comprising a base layer of hardboard 14 having a thickness of approximately 3 mm and a superposed layer of resilient foam material 16. Central opening 32 may conveniently be struck at the same time that the blank as a whole is struck. The striking operation itself is conventional, and is not here illustrated. Any other convenient method of cutting the blanks 40 may be employed as desired.

Blanks 40 are superposed with foam layer 16 facing upwardly on a continuous planar web 42 of thermoplastic film material 18, typically a plastized PVC, which unwinds from storage roll 44. A second planar web 46 of thermoplastic film material 20 is superposed on the blanks 40, and the sandwich transported on web 42 to a sealing station shown schematically in FIG. 5 and identified generally therein by the numeral 50. Sealing station 50 comprises a lower platen 52 and an upper platen 54 movable to and from the lower platen. Upper platen 54 carries a hollow sealing die 56 having a peripheral welding margin 58 conformed to the peripheral margin of blank 40 and dimensioned so as to closely surround the blank when positioned in the sealing die. When upper platen 54 is lowered with blank 40 sandwiched between films 18 and 20, sealing die 56 acts initially to stretch the upper film material quite tightly over the peripheral margin of blank 40, and to compress the resilient foam material, particularly in the vicinity of the peripheral margin of the blank, drawing film 20 downwardly until it abuts film 18 in the plane of the rear surface of base 14. Sealing die 56 is energized by any conventional means to fuse the contiguous film layers, thereby enclosing blank 40 in a sealing envelope, and radio frequency heat sealing is a preferred sealing process. It will be appreciated that films 18 and 20 may be sealed other than by a fusion process, however. Films 18 and 20 will be selected so as to be compatible with the sealing process to be employed. Generally speaking a plastized PVC film material is preferred for both films 18 and 20. Sealing die 56 will normally be constructed to include a knife edge immediately adjacent the welding surface of the die, so as to sever the enveloped clock faces 10 from the webs 42,46.

The clock faces 10 may be printed by any conventional process, for example by silk screening either prior to the sealing process or subsequent thereto, or for example, by embossing processes which may be included with the sealing step, and all of which are generally known in the art, and which are not depicted herein for this reason. The above illustrative embodiment is exemplary only of the presently preferred article and method therefor. The description is not intended to limit the broad aspects of the invention, for many departures may be made from the illustrative embodiment within the spirit of the claims appended hereto.

I claim:

1. A clock having a face comprising:

a rigid planar base layer;

a resilient padding layer overlaying said base layer, on the forward face thereof an enveloping film layer "surrounding said base layer and said padding" and a movement supported directly from said face.

2. A clock as defined in claim 1, wherein said enveloping film layer comprises preformed front and rear film layers fused together about the periphery of said face.

3. A clock as defined in claim 2, wherein said enveloping film layer is a plastized PVC film.

4. A clock as defined in claim 2, wherein said resilient padding is a polyurethane foam.

5. A clock as defined in claim 2, wherein said rigid base layer is a hardboard material.

6. A structural face clock including a face comprising:

a structural layer;

a layer of resilient padding covering the forward side of said base layer, an enveloping layer of a thermoplastic film surrounding said base layer and said padding, said thermoplastic film acting to compress said padding at least adjacent the peripheral margins of said structural base layer, and a movement secured directly to said face.

7. A method of manufacturing a clock face comprising:

providing a blank comprising a planar base layer and an overlaying layer of resilient padding and sealing said blank between an opposed pair of preformed plastic films.

8. A method as in claim 7, wherein said blank is cut from a laminate of said base layer and said padding layer.

9. A method as in claim 7, wherein one of said pair of preformed plastic films act as a transporting web for said blanks.

10. A method as in claim 7, further comprising the steps of decorating said clock face by silk screening and/or embossing.

11. A method as in claim 7, wherein said opposed pair of plastic films are fused together about the periphery of said blank.

12. A method as in claim 7, wherein said opposed pair of preformed plastic films are planar films.

* * * * *